US006223484B1

(12) United States Patent
Minter

(10) Patent No.: US 6,223,484 B1
(45) Date of Patent: May 1, 2001

(54) ROTATABLE INSTALLATION FIN FOR A FENESTRATION PRODUCT

(75) Inventor: Mearl J. Minter, Oskaloosa, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 09/309,153

(22) Filed: May 10, 1999

(51) Int. Cl.[7] ..... E06B 1/04

(52) U.S. Cl. ..... 52/213; 52/211; 52/204.55; 52/143; 49/504

(58) Field of Search ..... 52/204.1, 211, 52/213, 716.1, 716.2, 716.8, 717.01, 717.02

(56) References Cited

U.S. PATENT DOCUMENTS 5,119,609 * 6/1992 Tait ..... 52/213
5,210,986 5/1993 Hagemeyer et al. .
5,572,840 * 11/1996 Fast ..... 52/213
5,619,828 4/1997 Ver Meer .
5,701,780 * 12/1997 Ver Meer ..... 72/379.2

* cited by examiner

*Primary Examiner*—Carl D. Friedman
*Assistant Examiner*—Kevin McDermott
(74) *Attorney, Agent, or Firm*—Hovey, Williams, Timmons & Collins

(57) ABSTRACT

A preferred fenestration product (10), such as a window, includes a plurality of installation fins (22) rotatably coupled with the mounting surfaces (36) of respective frame members (28,30) of the product (10). Each fin (22) is rotatable between a retracted position in which the fin (22) is positioned flush against a respective mounting surface (36) and extends toward the outboard side (32) of the product (10), and an extended position in which the fin (22) extends outwardly from a respective mounting surface (36). This configuration allows the product (10) to be installed in a building opening (12), shimmed as needed for level and plumb with the fins (22) in the retracted position, and then rotated to the extended position and attached to the framework (16) surrounding the opening (12).

18 Claims, 3 Drawing Sheets

ROTATABLE INSTALLATION FIN FOR A FENESTRATION PRODUCT

BACKGROUND OF THE INVENTION

1. Field of the Invention

The present invention relates to the field of fenestration products including windows and doors. In particular, the invention is concerned with a fenestration product having a plurality of installation fins rotatably coupled with the mounting surfaces of respective frame members of the product.

2. Description of the Prior Art

Prior art fenestration products, such as doors and windows, include a frame having frame members such as head, sill and jambs with each frame member having an installation fin, usually composed of aluminum. One edge of a fin is attached to the exposed surface of a respective frame member. The fin is positioned flush against the frame member and extends toward the inboard side of the product.

In order to install the product in a building opening, the fin is bent so that it extends outwardly from the frame member. The product is then positioned in the building opening from the exterior side. One person must hold the product in place from the outside while a second person shims the product for level and plumb from the interior of the building. The fin is then nailed to the framework surrounding the opening in order to secure the product in place.

The requirement for two people to install a fenestration product represents inefficient use of labor and increases the installation cost of the product.

SUMMARY OF THE INVENTION

The present invention solves the prior art problems mentioned above and provides a distinct advance in the state of the art. In particular, the fenestration product hereof enables one-person installation thereby increasing labor efficiency and decreasing installed cost.

The preferred fenestration product of the present invention includes a fenestration structure having a frame with frame members presenting an outboard side, an inboard side, and a mounting surface therebetween, and includes an installation fin presenting a coupling crook rotatably coupled with the frame member between the outboard and inboard sides. The fin is rotatable between an extended position in which the fin extends outwardly from the mounting surface and a retracted position in which the fin is positioned substantially flush against the mounting surface and extends toward the outboard side. The fenestration structure and fin cooperatively present a configuration allowing positioning of the product in an installed position in a building opening with the fin in the retracted position, and allowing subsequent rotation of the fin to the extended position while the product is in the installed position in the building opening.

In preferred forms, the coupling crook of the fin presents a J-shaped configuration and is snap fitted in a complementally configured coupling slot defined in frame member. It is also preferred that the fin substantially cover the outboard section of the mounting surface between the coupling crook and the outboard side of the frame member. Other preferred aspects of the present invention are disclosed herein.

DETAILED DESCRIPTION OF THE PREFERRED EMBODIMENT

Figure 2:
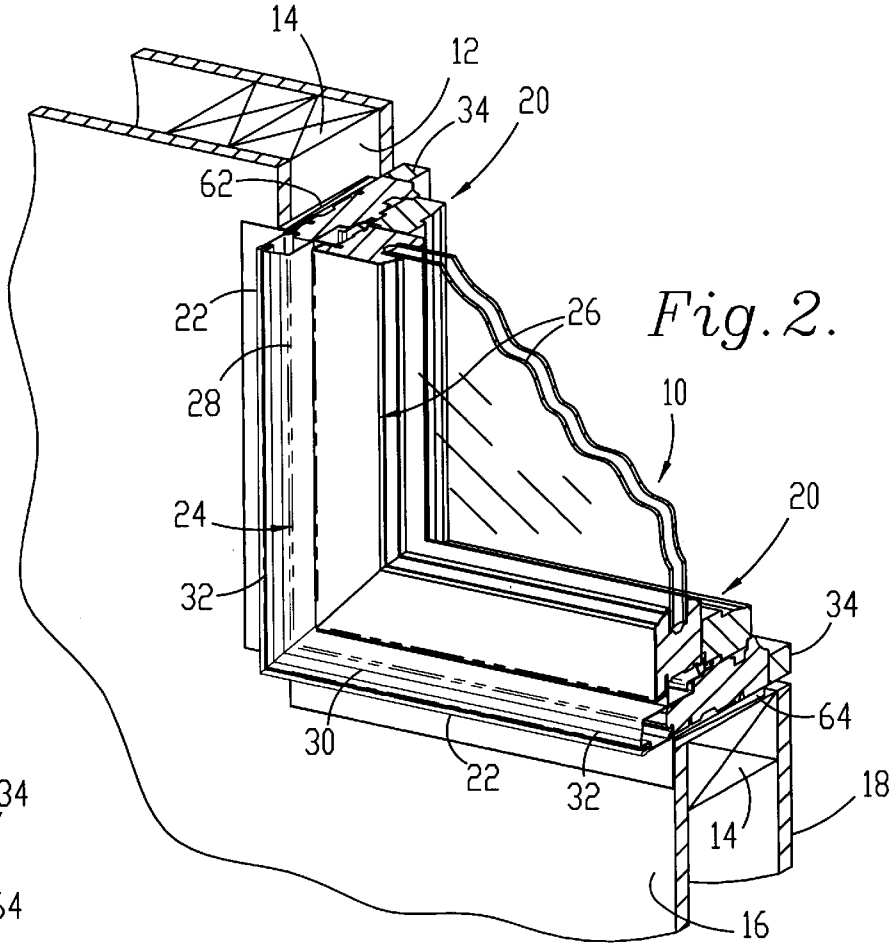
FIG. 2 is a view similar to FIG. 1 but showing the installation fin in the extended position.
Figure 1:
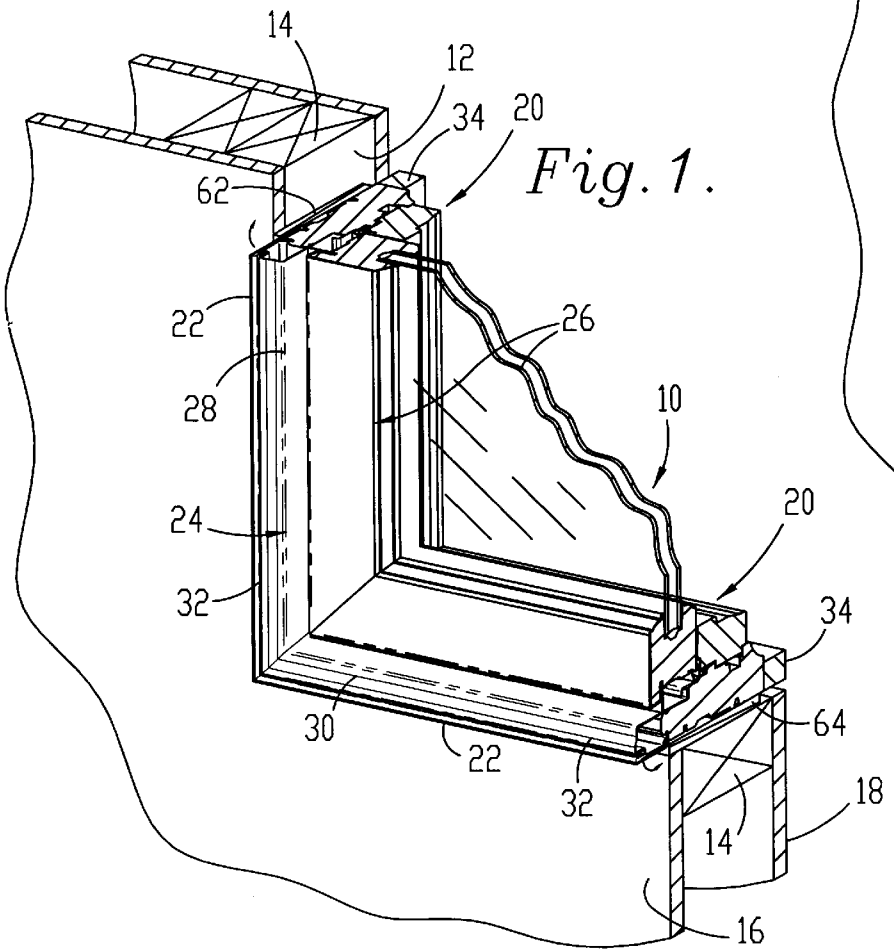
FIG. 1 is a partial pictorial view in partial section of the preferred fenestration product in accordance with the present invention shown positioned in a building opening with the installation fin in the retracted position.

FIGS. 1 and 2 illustrate preferred fenestration product 10 in the nature of a window shown in an installed position within building opening 12. Building framework 14 defines opening 12 and presents exterior face 16 and interior face 18. Fenestration product 10 includes fenestration structure 20 in the nature of a window assembly and installation fins 22.

Preferred fenestration structure 20 includes frame 24 supporting and surrounding sash 26. Frame 24 includes a plurality of frame members in the nature of head, sill and jambs illustrated by frame members 28 and 30 in FIGS. 1 and 2.

Referring to FIGS. 3–6, frame members 28 and 30 present outboard side 32, inboard side 34 and mounting surface 36 therebetween. Mounting surface 36 presents outboard section 38 adjacent outboard side 32, inboard section 40 adjacent inboard side 34, and juncture 42 therebetween. In the preferred embodiment, frame member 28 includes aluminum cladding 44 made up of outboard section 38 and outboard side 32. All of the frame members of fenestration structure 20 are similarly configured.

Frame members 28 and 30 also include coupling slot 46 defined in mounting surface 36. In particular, slot 46 is defined in cladding 44 at juncture 42. Slot 46 presents a generally C-shaped configuration with a lip 47 projection from the outbord section 38 into slot 46. Cladding 44 is formed to define an arcuate entrance wall 45 at the back of slot 46 and a bottom 48 adjacent lip 47.

Fenestration product 10 includes an elongated, generally transuerely J-shaped installation fin coupled with each frame member. Each installation fin 22 is preferably formed of rolled aluminum having a length sufficient to span the length of a corresponding frame member. As best viewed in FIGS. 3–7, fin 22 has an outboard surface 49, and its J-shaped configuration presents an arcuate coupling crook 50 and a straight stretch 54. Fin 22 also presents a proximal terminal end 51 and an opposite distal edge 52. The crook 50 of fin 22 is designed for a complemental snap fit in slot 46.

Figures 3, 4, 5, 6:
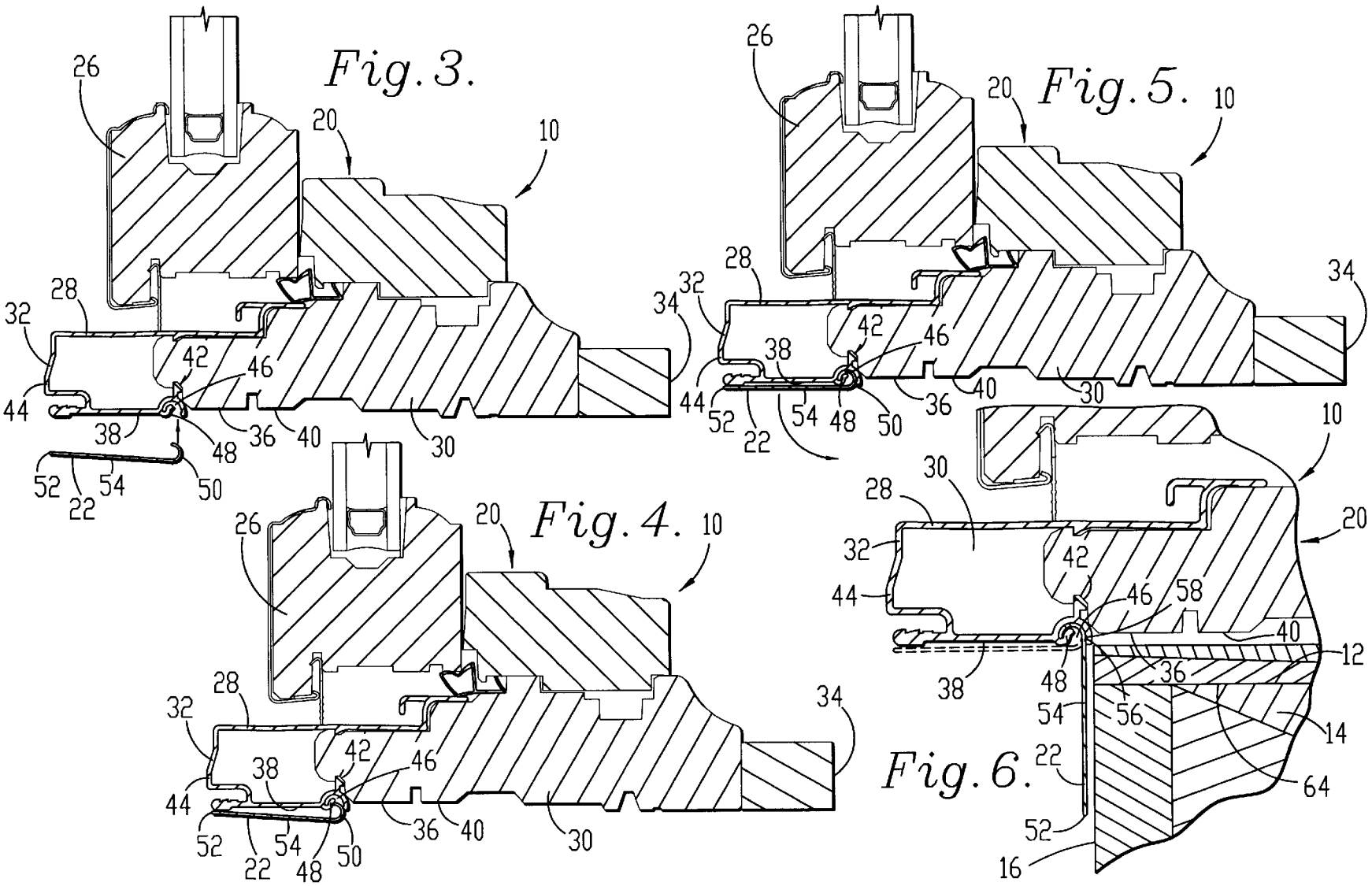
FIG. 3 is a partial sectional view of the fenestration product of FIG. 1 illustrating the coupling of the installation fin with a frame member.
FIG. 4 is a view similar to FIG. 3 but showing the coupling crook of the fin being received in the coupling slot.
FIG. 5 is a view similar to FIG. 4 but showing the coupling crook of the fin received in the coupling slot and showing the fin in the retracted position.
FIG. 6 is a partial sectional view of the fenestration product of FIG. 1 showing the fin in the extended position flush against the framework of the building defining the opening with the retracted position of the fin shown in phantom lines.

FIG. 3 illustrates fin 22 before reception of coupling crook 50 within coupling slot 46. Referring to FIG. 4, as coupling crook 50 is pressed into slot 46, coupling crook 50 engages lip 47. With continued pressure, coupling crook 50 snaps into slot 46 with lip 47 retaining coupling crook 50 in slot 46 as shown in FIG. 5.

FIG. 5 also illustrates fin 22 in the retracted position, which is also the preferred shipping position. In the retracted position, fin 22 is positioned substantially flush against mounting surface 38 and extends toward outboard side 32. In the preferred embodiment, fin 22 covers and protects outboard section 38 against damage during shipment when in the retracted position.

Figure 7:
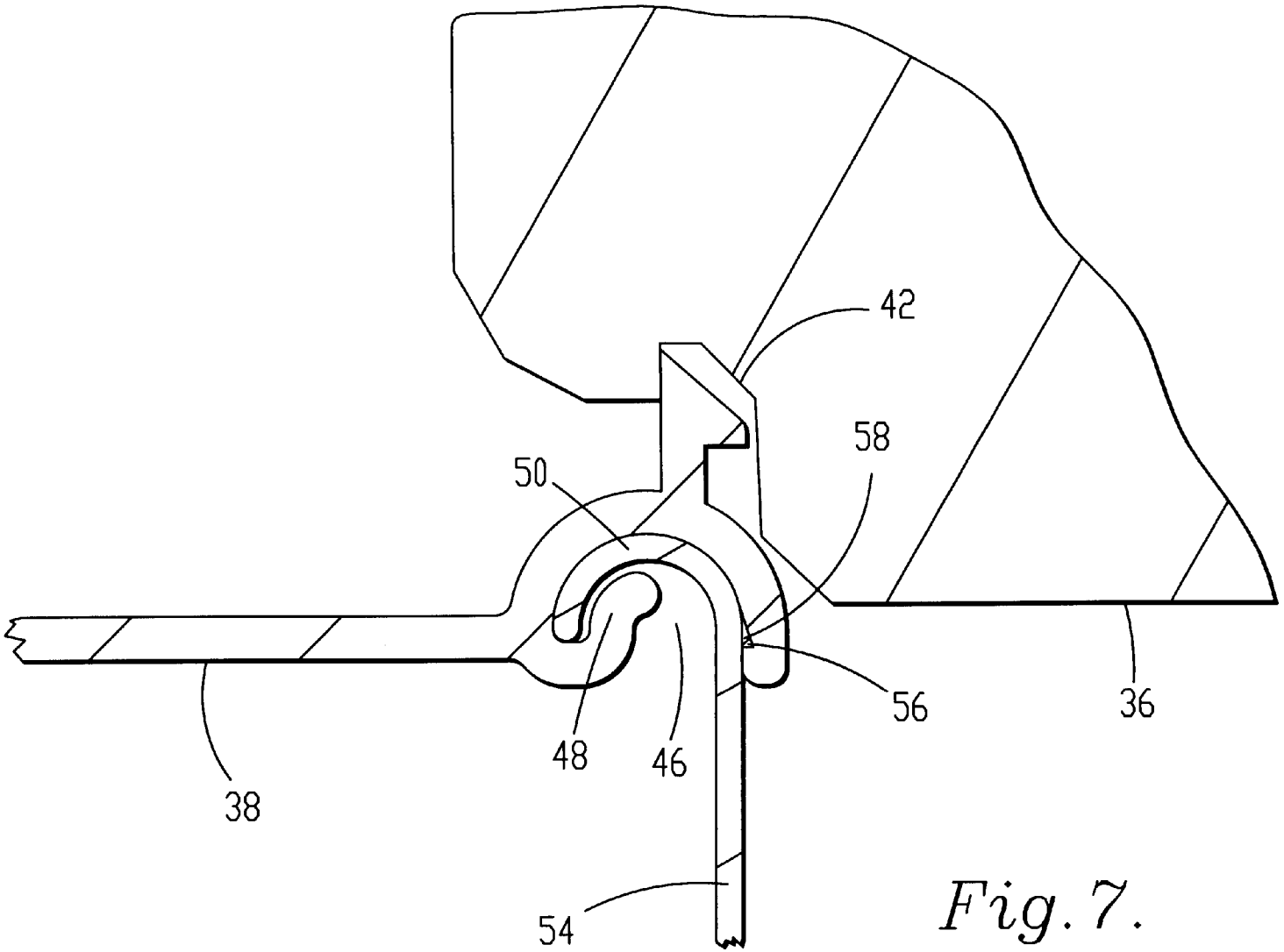
FIG. 7 is an enlarged partial view of the fin of FIG. 6 received in the coupling slot.
Figure 1:
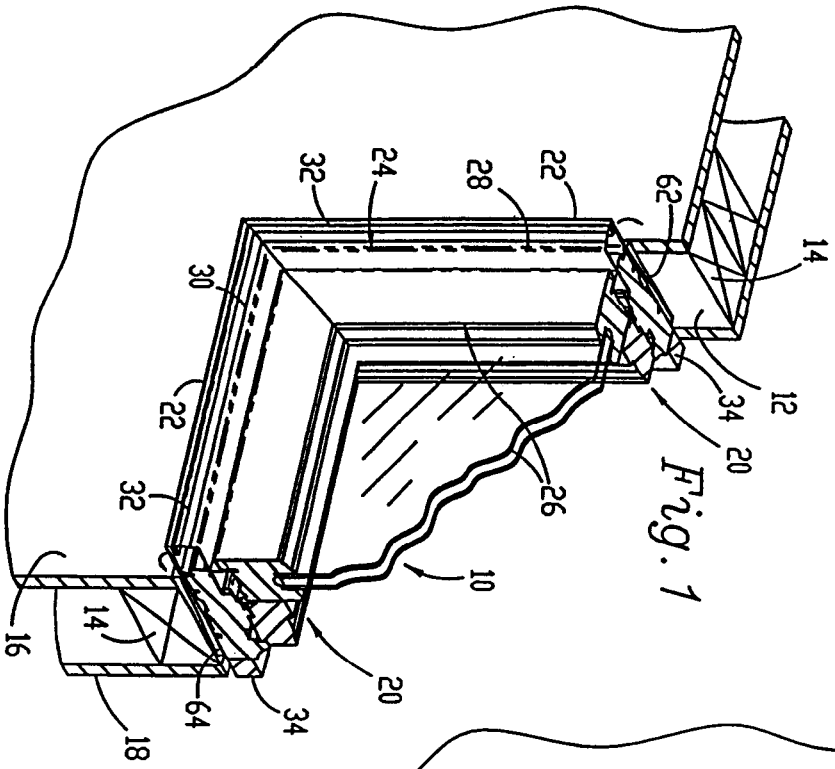
Figure 2:
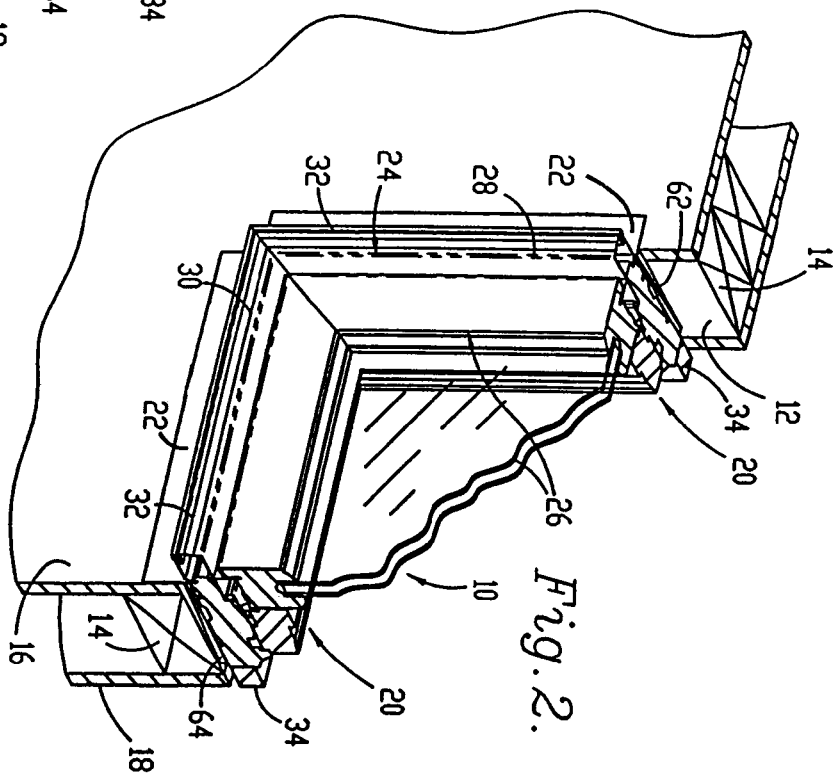
Figures 3, 4, 5, 6:
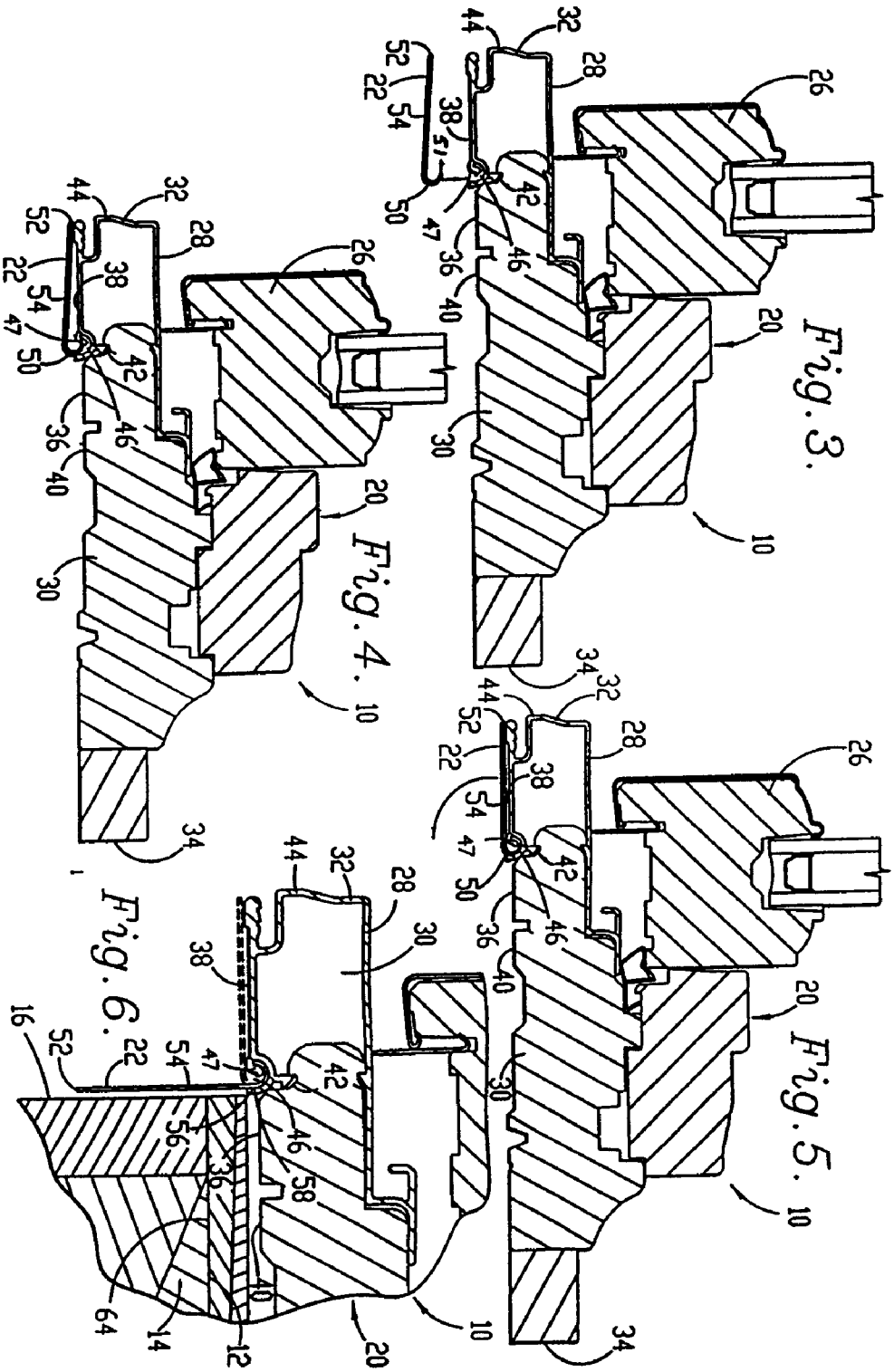
Figure 7:
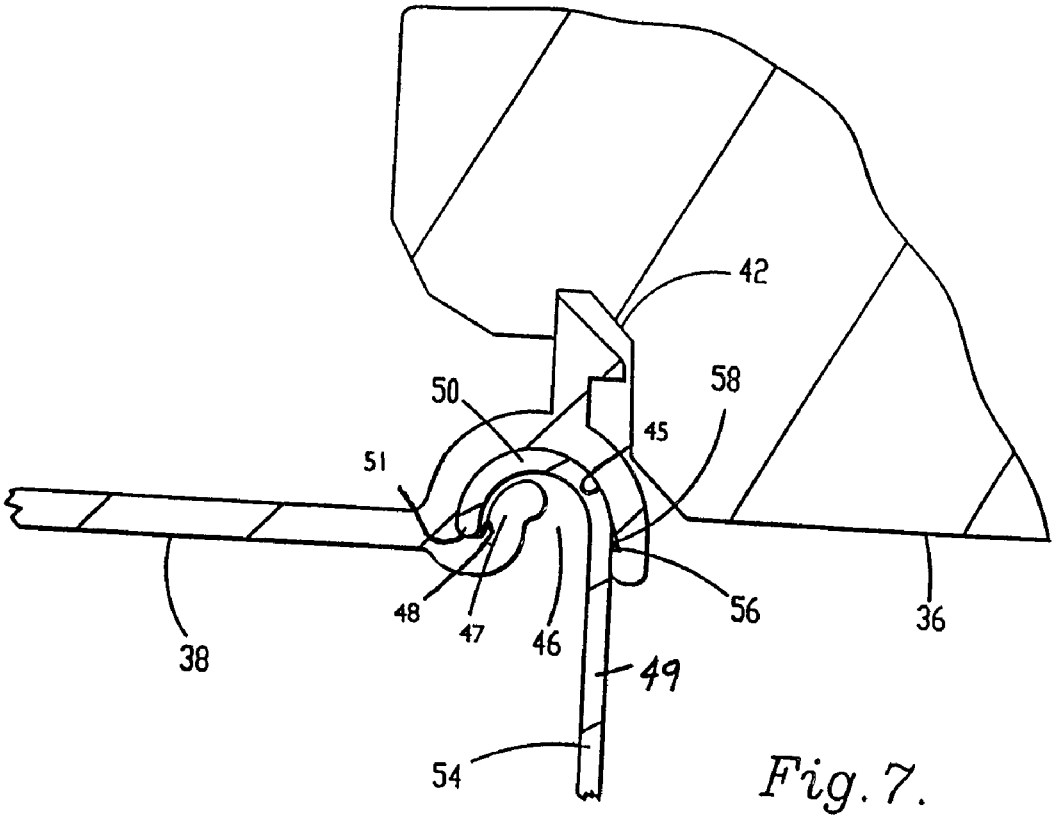

Referring to FIGS. 6 and 7, the complemental configurations of coupling slot 46 and coupling crook 50 allow rotation of fin 22 between the retracted position described above and shown in phantom lines, and the extended position in which fin 22 extends outwardly from mounting surface 36. In the preferred embodiment, coupling crook 50 and coupling slot 46 are configured so that the bottom 48 prevents further rotation of fin 22 when fin 22 is substantially perpendicular to mounting surface 36 in the extended position. As shown in FIG. 7, terminal end 51 abuts bottom 48 of coupling slot 46 when fin 22 the extended position.

As shown in FIG. 7, the entrance wall 45 of coupling slot 46 includes groove 56 configured to engage protrusion 58 defined in the outboard surface of coupling crook 50. Protrusion 58 is located adjacent the intersection of crook 50 an straight stretch 54 protrusion 58 is spaced so that groove 56 receives a respective protrusion to retain fin 22 in the extended position. The preferred configuration of fin 22 allows coupling crook 50 to shift within slot 46 thereby allowing rotation to the extended position without bending fin 22.

One of the advantages of the present invention is that it allows one person to install fenestration product 10. Referring to FIG. 1, and with fins 22 in the retracted position, fenestration product 10 is positioned in building opening 12. Product 10 is then shimmed using shims 62 and 64 as needed, for example, to level and plumb fenestration product 10 to achieve the desired installed position. As shown in FIG. 1, this is accomplished with fins 22 in the retracted position and can be accomplished from the exterior of the building opening.

With fenestration product 10 in the installed position within building opening 12, fins 22 are rotated to the extended position as illustrated in FIG. 2. Fins 22 are then attached to exterior face 16 of framework 14 by nails, screws or the like. This completes the installation of fenestration product 10 and can be accomplished by one person.

As those skilled in the art will appreciate, the present invention encompasses many variations in the preferred embodiments described herein. For example, the fins can be composed of materials other than the preferred aluminum and could be extruded rather than rolled. Also, the coupling crooks of the preferred fin can present other shapes and configurations to allow rotation in an appropriately configured slot or other coupling structure. Having thus described the preferred embodiments of the present invention, the following is claimed as new and desired to be secured by Letters Patent:

What is claimed is:

1. A fenestration product for installation in a building opening defined by a framework having an exterior face, said product comprising:

a fenestration structure including a frame having a frame member presenting an outboard side, an inboard side and a mounting surface therebetween, said frame member having an elongated coupling slot in said mounting surface and a lip projecting into said slot; and an elongated installation fin having a generally J-shaped transverse cross-sectional configuration, presenting a coupling crook, said coupling crook being rotatably received in said slot and hooked over said lip for rotation of the fin between a retracted position in which said fin is positioned substantially flush against said mounting surface and extends toward said outboard side and an extended position in which said fin extends outwardly from said mounting surface.

2. The product as set forth in claim 1, said coupling crook and coupling slot cooperatively presenting a snap fit configuration.

3. The product as set forth in claim 1, said mounting surface presenting an outboard section adjacent said outboard side and an inboard section adjacent said inboard side with a juncture therebetween, said coupling slot being positioned at said juncture, said fin being positioned substantially flush against said outboard section when in said retracted position.

4. The product as set forth in claim 3, said fenestration structure including cladding positioned and configured to present said outboard section, said coupling slot, and at least a portion of said outboard side.

5. The product as set forth in claim 3, said fin extending between said juncture and said outboard side and substantially covering said outboard section when in said retracted position.

6. The product as set forth in claim 3, said fin beginning at said juncture and extending beyond said outboard side thus protecting said outboard section from damage during shipping.

7. The product as set forth in claim 1, said fin being composed of aluminum.

8. The product as set forth in claim 6, said fin being composed of rolled aluminum.

9. The product as set forth in claim 1, said fin being substantially perpendicular to said mounting surface when in said extended position.

10. The product as set forth in claim 1, said coupling crook and coupling slot cooperatively presenting a snap fit configuration, said mounting surface presenting an outboard section adjacent said outboard side and an inboard section adjacent said inboard side with a juncture therebetween, said coupling slot being positioned at said juncture, said fin being positioned substantially flush against said outboard section when in said retracted position, said fenestration structure including cladding positioned and configured to present said outboard section, said coupling slot and at least a portion of said outboard side, said fin extending between said juncture and said outboard side and substantially covering said outboard section when in said retracted position, said fin being composed of rolled aluminum, said fin being substantially perpendicular to said mounting surface when in said extended position, said fenestration product including a plurality of said frame members and a corresponding plurality of said installation fins respectively coupled therewith.

11. The product as set forth in claim 1 including a plurality of said frame members and a corresponding plurality of said installation fins respectively coupled therewith.

12. The product as set forth in claim 1, said fin being rotatable from said retracted position to said extended position without bending said fin.

13. The product as set forth in claim 1, said crook being resilient.

14. The product as set forth in claim 1, said crook being resilient and presenting a smooth acuate curve.

15. The product as set forth in claim 1, said slot being bounded by an entrance wall, said fin and said entrance wall having interengageable locking structure disposed to mutually interlock with one another when said fin is in said extended position for retaining the fin in the extended position.

16. The product as set forth in claim 15, said fin having a straight stretch intersecting with and extending from said crook, and an outboard surface extending along said crook and said straight stretch, said locking structure comprising a protrusion on said outboard surface adjacent the intersection of said crook and said straight stretch and a groove in said entrance wall for matingly receiving said protrusion.

17. The product as set forth in claim 16, said slot having a bottom at the intersection of said lip and said outboard section, said groove being located in spaced opposition to said lip, said crook having a terminal end remote from said straight stretch, said fin being positively positioned by said terminal end abutting said bottom and said protrusion locking into said groove when said fin is in said extended position.

18. The product as set forth in claim 17, said fin being composed of rolled aluminum, said crook being resilient.

* * * * *

UNITED STATES PATENT AND TRADEMARK OFFICE

CERTIFICATE OF CORRECTION

PATENT NO. : 6,223,484 B1
DATED : May 1, 2001
INVENTOR(S) : Mearl J. Minter

It is certified that error appears in the above-identified patent and that said Letters Patent is hereby corrected as shown below:

Title page,
The title page should be deleted and substitute therefor the attached title page.

Drawings,
Delete drawing sheets 1-3, and substitute therefor the drawing sheets, consisting of FIGS. 1-7, as shown on the attached pages.

Signed and Sealed this

Thirtieth Day of July, 2002

*Attest:*

*Attesting Officer*

JAMES E. ROGAN
*Director of the United States Patent and Trademark Office*

(12) United States Patent
Minter

(10) Patent No.: US 6,223,484 B1
(45) Date of Patent: May 1, 2001

(54) ROTATABLE INSTALLATION FIN FOR A FENESTRATION PRODUCT

(75) Inventor: Mearl J. Minter, Oskaloosa, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 09/309,153

(22) Filed: May 10, 1999

(51) Int. Cl.[7] ..... E06B 1/04

(52) U.S. Cl. ..... 52/213; 52/211; 52/204.55; 52/143; 49/504

(58) Field of Search ..... 52/204.1, 211, 52/213, 716.1, 716.2, 716.8, 717.01, 717.02

(56) References Cited

U.S. PATENT DOCUMENTS 5,119,609 * 6/1992 Tait ..... 52/213
5,210,986 5/1993 Hagemeyer et al. .
5,572,840 * 11/1996 Fast ..... 52/213
5,619,828 4/1997 Ver Meer
5,701,780 * 12/1997 Ver Meer ..... 72/379.2

* cited by examiner

*Primary Examiner*—Carl D. Friedman
*Assistant Examiner*—Kevin McDermott
(74) *Attorney, Agent, or Firm*—Hovey, Williams, Timmons & Collins

(57) ABSTRACT

A preferred fenestration product (10), such as a window, includes a plurality of installation fins (22) rotatably coupled with the mounting surfaces (36) of respective frame members (28,30) of the product (10). Each fin (22) is rotatable between a retracted position in which the fin (22) is positioned flush against a respective mounting surface (36) and extends toward the outboard side (32) of the product (10), and an extended position in which the fin (22) extends outwardly from a respective mounting surface (36). This configuration allows the product (10) to be installed in a building opening (12), shimmed as needed for level and plumb with the fins (22) in the retracted position, and then rotated to the extended position and attached to the framework (16) surrounding the opening (12).

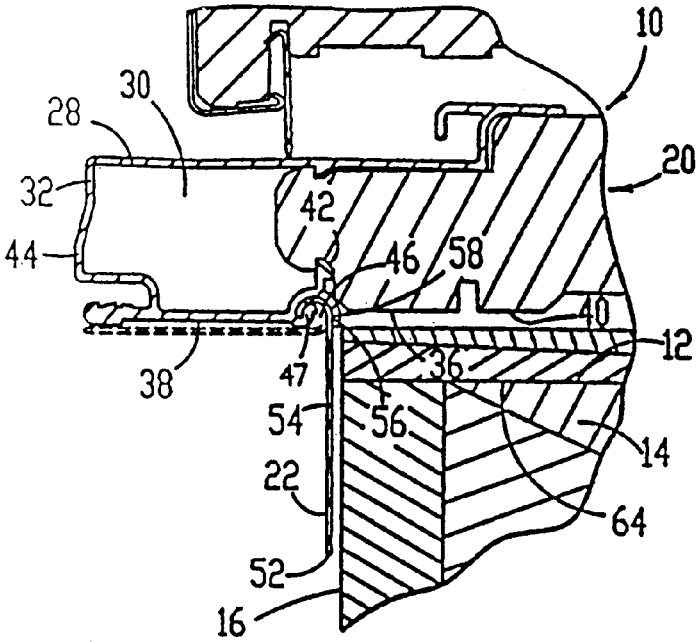

18 Claims, 3 Drawing Sheets